United States Patent [19]

Marzka

[11] 4,394,040

[45] Jul. 19, 1983

[54] GRAPPLE

[75] Inventor: Richard Marzka, 6051 Knoyle Rd., Erie, Pa. 16510

[73] Assignees: Richard Marzka; Mark R. Krahe, both of Erie, Pa.

[21] Appl. No.: 286,610

[22] Filed: Jul. 24, 1981

[51] Int. Cl.[3] ..... B66C 1/10

[52] U.S. Cl. ..... 294/66 R

[58] Field of Search ..... 294/19 A, 66 R, 82 R; 37/120, 121; 43/5, 42.7, 42.74; 56/400.01, 400.21; 114/294, 301, 304, 307

[56] References Cited

U.S. PATENT DOCUMENTS

| | | | |
|---|---|---|---|
| 1,758,149 | 5/1930 | Dilworth | 294/66 R |
| 2,873,997 | 2/1959 | Thomas | 294/66 R |
| 3,336,067 | 8/1967 | Cloyd | 294/66 R |

FOREIGN PATENT DOCUMENTS

| | | | |
|---|---|---|---|
| 811619 | 4/1969 | Canada | 294/66 R |
| 91889 | 6/1958 | Norway | 294/66 R |

*Primary Examiner*—Johnny D. Cherry
*Attorney, Agent, or Firm*—Charles L. Lovercheck; Wayne L. Lovercheck; Dale R. Lovercheck

[57] ABSTRACT

A grapple made up of a triangular frame having sides originally attached together at their apex as disclosed. A line can be attached to one apex and hooks having eyes received on the side opposite the apex have tubular member received on the side opposite the apex between the hooks. The hooks have hook members, each of which runs outwardly in a direction opposite the hooks on either side of it.

3 Claims, 3 Drawing Figures

FIG 1
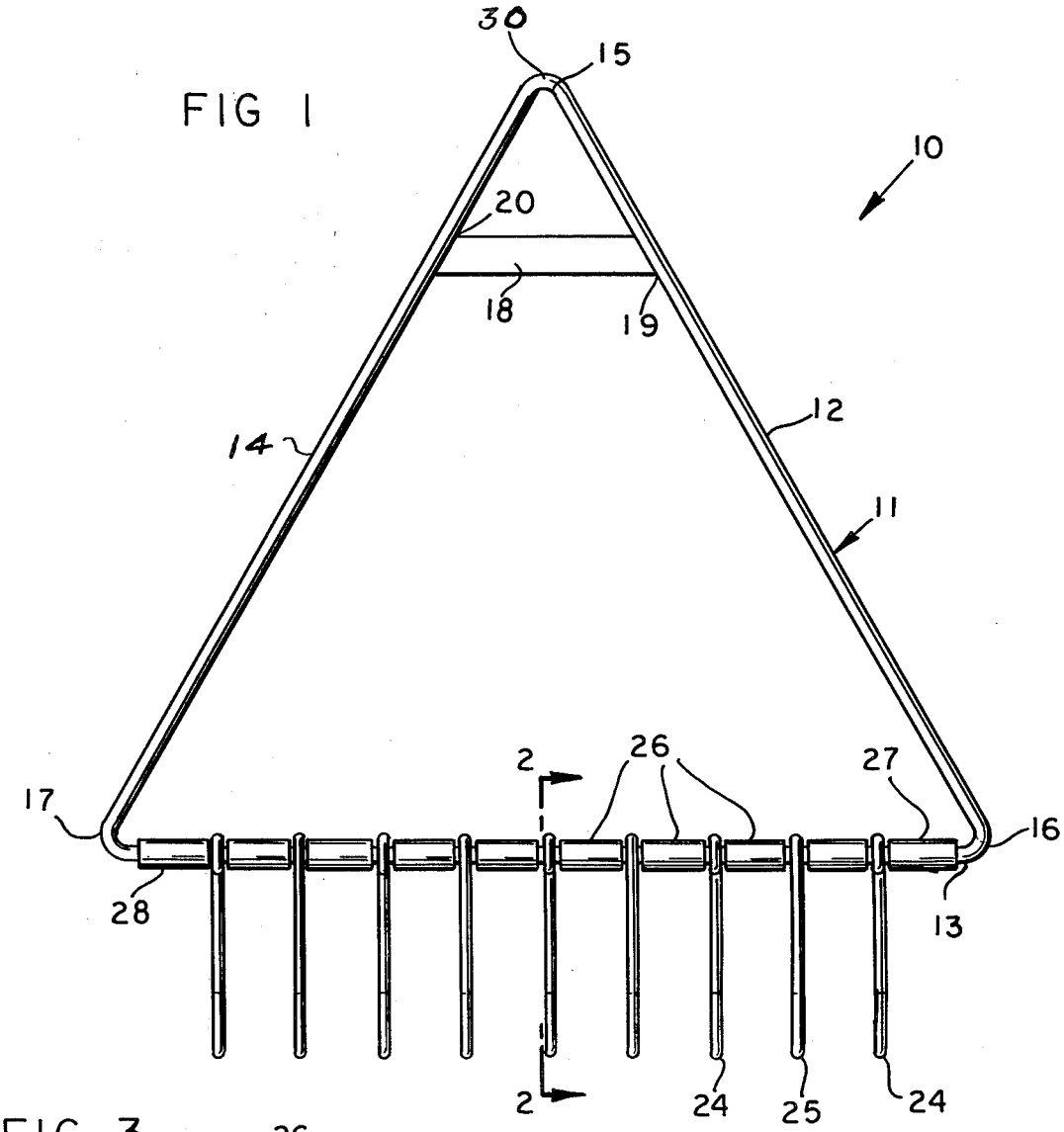
FIG 3
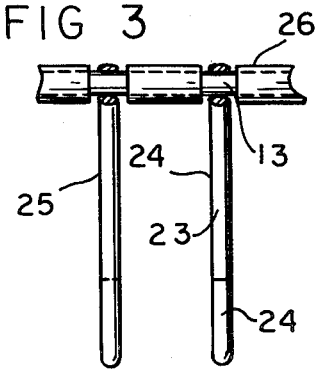
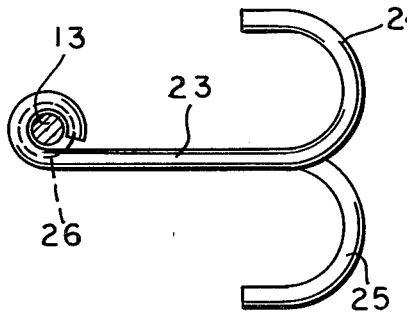
FIG 2

GRAPPLE

GENERAL DESCRIPTION OF THE INVENTION

The grapple disclosed here can be towed behind a boat on a body of water and will pick up foreign objects in the bottom of a body of water such as bicycles, fishing rods and other paraphernalia that has dropped into the water. The grapple can be used as an interesting hobby to recover objects lost in lakes, rivers, and the like. It has a triangular frame which holds the hooks in working position and the hook face in opposite directions so that they will always be in a position to engage the articles to be recovered.

REFERENCE TO PRIOR ART

The following patents show grapples of various types but none of them show uniformly spaced grapples constructed in applicant's hook extending in opposite directions from each other.

U.S. Pat. No. 2,551,998
U.S. Pat. No. 2,649,327
U.S. Pat. No. 2,873,997
U.S. Pat. No. 3,336,067

OBJECTS OF THE INVENTIONS

The object of the invention is to provide improved grapple.

Another object of the invention is to provide a grapple that is simple in construction, economical to manufacture and simple and efficient to use.

Another object of the invention is to provide a grapple especially suitable for recovery of foreign objects from lakes, rivers and other bodies of water.

With the above and other objects in view, the present invention consists of the combination and arrangement of parts hereinafter more fully described, illustrated in the accompanying drawing and more particularly pointed out in the appended claims, it being understood that changes ay be made in the form, size, proportions and minor details of construction without departing from the spirit or sacrificing any of the advantages of the invention.

GENERAL DESCRIPTION OF THE DRAWINGS

FIG. 1 is a side view of a grapple according to the invention.

FIG. 2 is a cross-sectional view taken on Line 22 of FIG. 1.

FIG. 3 is an enlarged partial view of a part of the grapple.

DETAILED DESCRIPTION OF THE DRAWINGS

Now with more particular reference to the drawing, the grapple disclosed is made up of a frame 11, which may be made of a round steel rod or bent tube in the form of an equilateral triangle having first side 12, second side 13 and third side 14 connected together at apexes 15, 16, and 17. The frame may be made of a single rod bent on an arc at the apexes 15 and 17 and welded together at apex 16 for example or at any other desired position. The brace 18 is connected to the first side 12 at 19 and to the third side 14 at 20 by welding or other suitable fastening means.

The hook members 24 and 25 have an eyelet formed on one end and receive the second side 13 and are formed by bending the hook member on the straight portion 23 with the hook 24 on the end opposite the eye. Each alternate hook 25 is bent in the opposite direction from the hooks adjacent to the hooks 24. The tubular spacers 26 are received on the second side 13 and hold the alternate hooks 24 and 25 in spaced relation to each other. The spacers 27 and 28 are arranged at each end of the frame to hold the end hooks from interfering with the frame.

A flexible line may be attached at 30 and can be fastened around the apex 15 to tow the grapple through the water. The grapple may be used by throwing it into the water from a boat, dock or pier and towing it along by means of a line. Either hook 24 or the hook 25 will always extend downward to catch articles to be recovered.

The line may be attached at 30 to then tow the grapple.

The foregoing specification sets forth the invention in its preferred, practical forms but the structure shown is capable of modification within a range of equivalents without departing from the invention which is to be understood is broadly novel as is commensurate with the appended claims.

The embodiment of the invention in which an exclusive property or privilege is claimed are defined as follows:

1. Apparatus for grapple which comprises:

a relatively rigid frame (11), said frame (11) being formed generally in the shape of a triangle having a first straight side (12), a second straight side (13) and a third straight side (14), said first side and said third side being connected together at a first apex, said first side and said second side being connected together at a second apex and said second and third sides being connected together at a third apex., said first apex being adapted to have a line attached thereto, a plurality of hook members (24,25) swingably mounted on said second side (13), each said hook member having an elongated straight portion (23), an eye formed on one end of said elongated straight portion and a curved hook (24, 25) formed in the other end of said elongated straight portion, said eyes receiving said second side, a plurality of tubular spacers (26) received on said second side (13), each said spacer being received on said second side between each two adjacent said eyes, a cross member (18) extending from said first side adjacent said first apex and to said third side and attached to said first side and said third side, each said hook member having its said curved hook extending in a different direction from the said hooks adjacent thereto, said hook members terminating in an end portion extending generally parallel to said straight portion and terminating in a flat end.

2. The grapple recited in claim 1 wherein said frame is formed of a rod forming a continuous said triangle.

3. The grapple recited in claim 2 wherein said grapple has the corner of said first apex bent on a radius.

* * * * *